US005800230A

United States Patent [19]

Horiuchi et al.

[11] Patent Number: 5,800,230

[45] Date of Patent: Sep. 1, 1998

[54] CONJUGATED FILAMENT NONWOVEN FABRIC AND METHOD OF MANUFACTURING THE SAME

[75] Inventors: Shingo Horiuchi; Taiju Terakawa; Toshikatsu Fujiwara, all of Shiga, Japan

[73] Assignee: Chisso Corporation, Osaka, Japan

[21] Appl. No.: 925,039

[22] Filed: Sep. 8, 1997

[30] Foreign Application Priority Data

Sep. 11, 1996 [JP] Japan ..... 8-240748

[51] Int. Cl.[6] ..... D03D 3/00

[52] U.S. Cl. ..... 442/352; 156/167; 156/209; 156/296; 156/308.4; 442/361; 442/409

[58] Field of Search ..... 442/352, 361, 442/409; 156/167, 209, 296, 308.4

[56] References Cited

FOREIGN PATENT DOCUMENTS 63-282350 11/1988 Japan .
63-282351 11/1988 Japan .
1-201503 8/1989 Japan .
2-182961 7/1990 Japan .
2-269854 11/1990 Japan .
2-289159 11/1990 Japan .

*Primary Examiner*—James J. Bell
*Attorney, Agent, or Firm*—Merchant, Gould, Smith, Edell, Welter & Schmidt, P.A.

[57] ABSTRACT

A bulky and highly strong filament nonwoven fabric and method of manufacturing the filament nonwoven fabric which is made of conjugated filaments, whose intersections are melted and adhered, and which has a 15–35 cc/g specific volume and satisfies the following Formula (1) between strength and specific volume;

$$Y \geqq -1.25X+125 \quad (1)$$

wherein Y is a geometrical mean of vertical and horizontal strength per 5 cm wide and 1 g/cm$^2$ nonwoven fabric [unit: g/(g/m$^2$·5 cm]; Y=(MD×CD)$^{1/2}$ where MD is vertical strength [unit: g/(g/m$^2$·5 cm] and CD is horizontal strength [unit: g/(g/m$^2$·5 cm]; and X=specific volume of a nonwoven fabric [unit: cc/g]; and wherein the conjugated filament is made of a low melting point polymer and a high melting point polymer with a difference in melting points of at least 15° C., and has the low melting point polymer on at least one section of a filament surface and has crimps.

20 Claims, No Drawings

CONJUGATED FILAMENT NONWOVEN FABRIC AND METHOD OF MANUFACTURING THE SAME

FIELD OF THE INVENTION

This invention relates to a conjugated filament nonwoven fabric and a method of manufacturing the same. More specifically, this invention relates to a nonwoven fabric in which the intersections of thermally fusible conjugated filaments are thermally melted and adhered to each other and which has a balanced bulkiness and strength, and a method of manufacturing the same. The nonwoven fabric of this invention is used as a sanitary material for disposable diapers, etc. and as other materials for filters, clothes, wipers, building materials, and the like.

BACKGROUND OF THE INVENTION

A conjugated thermally fusible nonwoven fabric manufactured by a spun bond method has been recently developed and industrialized. The nonwoven fabric is manufactured by the steps of drawing conjugated filaments, spinning from a spinning pack, by a high-speed air flow; sucking the high-speed flow from the bottom of a scavenging device such as a net conveyor so as to accumulate the filaments on the device, thus forming a web; and treating the web with heat.

Japanese Patent Application Tokkai Sho 63-282350 discloses a method of manufacturing a bulky filament nonwoven fabric, which has a preferable number of crimps and has little nonwoven fabric basis weight spots (uniform weight of nonwoven fabric), by spinning two kinds of thermoplastic polymers with a conjugating spun bond method. Japanese Patent Application Tokkai Hei 2-289159 discloses a conjugated spun bond filament nonwoven fabric made of a copolymer of propylene and another of α olefin and a polyethylene mixture/polypropylene. Japanese Patent Application Tokkai Hei 2-182961 discloses a conjugated spun bond filament nonwoven fabric made of parallel conjugated filaments of polyetylene/thermoplastic polymer, and a method of manufacturing the same.

In order to soften a nonwoven fabric in the above-mentioned Japanese Patent Application Tokkai Sho 63-282350 and Tokkai Hei 2-289159, conjugated spun bond filament webs are collided against a metal plate during the process of spinning the webs; bulkiness is added to the webs by standardizing and crimping the webs with corona discharge; or a particular thermoplastic polymer is mixed. In other words, the nonwoven fabric has no balanced bulkiness and strength. That is, the nonwoven fabric has no strength but only bulkiness and softness. Therefore, these inventions are limited to the usage of nonwoven fabrics which require little strength. In Japanese Patent Application Tokkai Hei 2-182961, a nonwoven fabric is prepared by conjugating and spinning particular thermoplastic polymers. Even though the nonwoven fabric may have improved heat sealing properties, it has no balanced bulkiness and strength. In other words, none of the above-mentioned references discloses a method of manufacturing a conjugated filament nonwoven fabric having both excellent bulkiness and strength.

SUMMARY OF THE INVENTION

In order to resolve these and other problems of the conventional techniques, this invention provides a conjugated filament nonwoven fabric with a balanced bulkiness and strength, and a method of manufacturing the same.

Moreover, this invention provides a conjugated filament nonwoven fabric whose tension can be used in the field and which can be used along with other materials at high speed by adding tension and can be additionally processed, and a method of manufacturing the same.

The above-mentioned problems are solved by the following:

(A) A filament nonwoven fabric made of conjugated filaments, which are made of a low melting point polymer and a high melting point polymer with at least 15° C. difference in the melting points with the low melting point polymer on at least one section of the filament surface and having crimps, with the intersections of the conjugated filaments being melted, has a 15–35 cc/g specific volume, and satisfies the following formula (1) between strength and specific volume;

$$Y \geqq -1.25X+125 \quad (1)$$

wherein Y is the geometrical mean of vertical and horizontal strength per 5 cm wide and 1 g/cm$^2$ nonwoven fabric [unit: g/(g/m$^2$·5 cm]; $Y=(MD\times CD)^{1/2}$ where MD is vertical strength [unit: g/(g/m$^2$·5 cm] and CD is horizontal strength [unit: g/(g/m$^2$·5 cm]; and X=specific volume of a nonwoven fabric [unit: cc/g].

(B) The filament nonwoven fabric mentioned in (A), wherein the low melting point polymer is a polyethylene of high density which has 0.950–0.965 density at a melt index (MI) of 20 or less.

(C) The filament nonwoven fabric described in (A) or (B), wherein the high melting point polymer is a crystalline polypropylene having a 3.5 or less Q value at 10 or less MFR.

(D) A method of manufacturing a filament nonwoven fabric including the steps of spinning conjugated filaments, which are made of a low melting point polymer and a high melting point polymer with at least 15° C. difference in the melting points, by a conjugating spun bond method; blowing webs by a high-speed flow against a scavenging device and sucking and removing the blown high-speed flow from the device; carrying out a preliminary bulkiness treatment; adding crimps and bulkiness, and thermally fusing the intersections among the conjugated filaments by treating the web with heat at a temperature higher than the melting point of the conjugated filaments, thus manufacturing the filament nonwoven fabric having a 15–35 cc/g specific volume and satisfying the conditions between the strength and specific volume of the nonwoven fabric shown in the following Formula (1);

$$Y \geqq -1.25X+125 \quad (1)$$

wherein Y is the geometrical mean of vertical and horizontal strength per 5 cm wide and 1 g/cm$^2$ nonwoven fabric [unit: g/(g/m$^2$19 5 cm]; $Y=(MD\times CD)^{1/2}$ where MD is vertical strength [unit: g/(g/m$^2$·5 cm] and CD is horizontal strength [unit: g/(g/m$^2$·5 cm]; and X=specific volume of a nonwoven fabric [unit: cc/g].

(E) The method of manufacturing a filament nonwoven fabric mentioned in (D), wherein the heat treatment is a hot air through treatment at a temperature between the melting point of the low melting point polymer and that of the high melting point polymer.

(F) The method of manufacturing a filament nonwoven fabric mentioned in (D), wherein the heat treatment is thermo-compression bonding by a hot embossed roller at a temperature between the softening point of the low melting point polymer and the melting point of the high melting point polymer.

(G) The method of manufacturing a filament nonwoven fabric described in (D), (E) or (F), wherein after the high-speed flow is sucked and removed from the scavenging device, and the preliminary bulkiness treatment provides a high-speed flow suction interrupted zone in a process before the heat treatment of the web.

DETAILED DESCRIPTION OF THE INVENTION

The nonwoven fabric of this invention is made of thermally fused and conjugated multicomponent filaments, and has a particular relationship between its specific volume and strength.

The conjugated filaments used for the nonwoven fabric of this invention are provided by a conjugating spun bond method, or the like. The conjugated filaments are made of a low melting point polymer and a high melting point polymer, and the difference in the melting points between the low melting point polymer and the high melting point polymer is at least 15° C. At least one section of the filament surface is made of the low melting point polymer, and the conjugated filaments have crimps. If the difference in the melting points is less than 15° C., it would be difficult to control the temperature of the heat treatment. Thus, the thermal fusion of the webs becomes insufficient, and nonwoven fabrics with strength cannot be provided. On the contrary, with excessive thermal fusion, a nonwoven fabric tends to become a film, thus lowering bulkiness. In other words, nonwoven fabrics with a balanced bulkiness and strength cannot be provided. The conjugated filaments should have a low melting point polymer on at least one section of the filament surface, and a nonwoven fabric made of the filaments should have crimps. There are, for example, sheath-core type, eccentric sheath-core type, parallel type, sea-island type, etc. conjugated filaments.

A nonwoven fabric of the conjugated filaments should have about 1–80crimps/25 mm, more preferably around 1.2–70 crimps/25 mm, or more preferably about 1.5–60 crimps/25 mm. The shape of the crimps may be a rough U-shape, rough Ω-shape, rough V-shape, spiral shape, or a mixture of shapes mentioned above.

The composition ratio of the low melting point and the high melting point materials is preferably about 10–90 wt. % for the low melting point and about 90–10 wt. % for the high melting point. Such a range of the composition ratio can prevent the lack of thermal fusion of filaments which is caused by too small a composition ratio of the low melting point polymer, thus providing nonwoven fabrics with sufficient strength and preventing fluff from being formed on the nonwoven fabrics. Furthermore, if a composition ratio of the low melting point polymer is higher than the ratio mentioned above, excessive thermal fusion of filaments would occur, resulting in melting and cutting of the filaments. A nonwoven fabric made of such filaments will also tend to be in a film condition, and will have inferior softness and air permeability. It is more preferable if the composition ratio is around 30–70 wt. % for the low-melting point polymer and around 70–30 wt. % for the high-melting point polymer. With this composition ratio, the problems mentioned above can certainly be prevented.

Thermoplastic polymers are preferably used as a material for the conjugated filaments of this invention, including e.g., polyamides such as nylon 6 and nylon 66, polyesters such as polyethylene terephthalate, polybutylene terephthalate and low melting point polyesters in which isophthalic acid is copolymerized, polyolefins such as polypropylene, polyethylene of high density, polyethylene of medium density, polyethylene of low density, straight-line low density polyethylene, binary or ternary copolymers of propylene and other α olefins, and the mixture of the above-noted polymers.

The combination of the polymers should not inhibit the effects of this invention, provided there is a difference in the melting points of at least 15° C. For instance, the combination includes high density polyethylene/polypropylene, low density polyethylene/propylene •ethylene •butene-1 ternary copolymer, high density polyethylene/polyethylene terephthalate, polypropylene/polyethylene terephthalate, mixture of straight-chain low-density polyethylene and high density polyethylene/polypropylene, and the like. Considering bulkiness, strength and the like of nonwoven fabrics, the spinning characteristics of conjugated filaments, economic aspects, etc., the combination of polyethylene/polypropylene is most preferable. The polyethylene preferably has about 0.950–0.965 density, and has a MI of about 20 or less (melt index; 190° C.; g/10 minutes; by ASTM-D-1238 (E)). More preferably, the polyethylene is a highly-dense polyethylene with 20-6 MI. By using a polyethylene of high density, a nonwoven fabric can be provided which has preferable crimp properties, and sufficient bulkiness and strength. The polypropylene preferably has a MFR of about 10 or less MFR (melt flow rate; 230° C.; g/10 minutes; JIS-K7210; based on Condition 14 of Table 1), or more preferably 10-6 MFR. The polypropylene also preferably has around 3.5 or less Q value (in other words, average molecular weight [Mw]/average molecular weight [Mn]), or more preferably around 3.5–1.5. The polypropylene with this range of Q value has a relatively sharp molecular weight distribution. By using such polypropyelene, a nonwoven fabric with preferable crimp properties and sufficient bulkiness and strength is provided.

It is difficult to set the range of single filament fineness of this invention because the range differs, depending on the purposes of nonwoven fabrics. However, when the fabrics are used for materials such as disposable diapers and sanitary napkins, the fineness is preferably around 0.2–12 d/f. When they are used for wrapping materials and covering materials for agricultural purposes, etc., the fineness is preferably about 0.5–15 d/f. Furthermore, the fineness would preferably be around 3–3000 d/f if the fibers are used for construction purposes. There is no particular limitation on the basis weight (weight per unit area) of nonwoven fibers, but the basis weight is preferably around 4–2000 g/cm$^2$ so as to uniformly melt the inside of the nonwoven fibers.

It is necessary that the nonwoven fibers of this invention have a 15–35 cc/g specific volume, and satisfy a correlation between the specific volume and strength of nonwoven fabrics shown in the following formula (1).

$$Y \geqq -1.25X+125 \quad (1)$$

wherein Y is the geometrical mean of vertical and horizontal strength per 5 cm wide and 1 g/cm nonwoven fabric [unit: g/(g/m$^2$·5 cm]; $Y=(MD\times CD)^{1/2}$ where MD is vertical strength [unit: g/(g/m$^2$·5 cm] and CD is horizontal strength [unit: g/(g/m$^2$·5 cm]; and X=specific volume of a nonwoven fabric [unit: cc/g].

Regarding MD, vertical strength is the maximum tensile strength in the machine direction of the nonwoven fabric;

regarding CD, horizontal strength is the maximum tensile strength in the horizontal direction, that is the direction traversing perpendicularly to the machine direction.

If not the above-noted correlation but only the specific volume of the nonwoven fabric of the invention is satisfied ($Y<-1.25X+25$), the fabric would be too weak. Thus, the usage of the fabric would be limited, and it cannot be used for multiple purposes. Especially, the fabric cannot be used in a field where tension or external stress is added to the nonwoven fabric during usage or during additional processing. More specifically, the fabric would not be strong enough for the front or back surface materials of disposable diapers, wipers, bandages, etc. Also, in processing disposable diapers by laminating the nonwoven fabrics with other films or other nonwoven fabrics, certain stress has to be added to the nonwoven fabrics. But if the fabric does not satisfy the condition of Formula (1) mentioned above, the nonwoven fabric would be cut in processing and fluff would be wound onto various rollers, so that it becomes difficult to carry out processing at high speed. It also becomes impossible to use the fabric along with other materials when tension or the like is added.

The nonwoven fabric of this invention can be manufactured by the conjugating spun bond method mentioned below. In this method, various polymers are melted and forced out of a plurality of extruders, and conjugated fibers in which multicomponents are conjugated are spun from a conjugating spinning pack. The spun fibers are drawn by a high-speed flux drawing type device such as an air sucker, and the fibers along with the flux are scavenged by a web scavenging device such as a net conveyer. The web is then treated with heat, thus thermally fusing and adhering the fibers. The air flux which is blown with the web is sucked and removed from the bottom section of the scavenging device.

In order to satisfy the correlation between the specific volume and strength of the nonwoven fabric of this invention mentioned above, the spinning conditions of the conjugating spun bond method, the preliminary bulkiness treatment conditions before the heat treatment of the spun web, and the heat treatment conditions are selected. This is an effective way of choosing particular polymers such as the polyethylene of high density and polypropylene described above. It is also effective to treat the spun web with heat after carrying out the preliminary bulkiness treatment. In other words, after crimps are formed on the conjugated filaments in the preliminary bulkiness treatment, they are treated with heat, thus providing nonwoven fabrics with a balanced specific volume and strength. The crimps may be formed on the web on the scavenging device right after the spinning process without the preliminary bulkiness treatment. In other words, the crimps may be formed at the scavenging device during the process of sucking and removing the high-speed flux blown together with the conjugated filaments. However, with the preliminary bulkiness treatment, nonwoven fabrics obtain further balance in bulkiness and strength.

In the conjugating spinning process, a conjugated filament is spun in which at least one section of the filament surface is made of a low melting point polymer. The spinning pack includes a sheath-core type, eccentric sheath-core type, parallel type, sea-island type, etc. During the spinning process, extracted filaments can be quenched between the spinning pack and a high-speed flux sucking device. In this invention, conjugated filaments are blown against the scavenging device along with high-speed flux, thus scavenging the web. After sucking and removing the blown flux from of the scavenging device, the heat treatment is carried out on the filaments after carrying out the preliminary bulkiness treatment.

The low melting point polymer of the filament nonwoven fabric of this invention is polyethylene of high density having a MI of 20 or less and 0.950–0.965 density. Thus, the nonwoven fabric of this invention has preferable crimp properties, bulkiness and strength.

The high melting point polymer of the filament nonwoven fabric of this invention is a crystalline polypropylene having a MFR of 10 or less and Q value of 3.5 or less, so that the nonwoven fabric has excellent crimp properties, bulkiness and strength.

Also, in the method of manufacturing the filament nonwoven fabric of this invention, the nonwoven fabric can be effectively manufactured.

In the method of the invention, the hot air through treatment is carried out at a temperature between the melting point of the low melting point polymer and the melting point of the high melting point polymer. Thus, the method of this invention can easily manufacture the filament nonwoven fabric of this invention having good bulkiness.

In the method of the invention, the heat treatment is carried out by a hot embossed roller at a temperature between the softening point of the low melting point polymer and the melting point of the high melting point polymer. Thus, the speed of manufacturing nonwoven fibers improves, and the method is highly productive and economical.

Furthermore, after sucking and removing high-speed flux from a scavenging device in the process of spinning by a conjugating spun bond method, a high-speed flux suction interrupted zone is provided in the preliminary bulkiness treatment before the heat treatment process. Thus, the filament nonwoven fabric of this invention can be easily manufactured.

A specific example of the preliminary bulkiness treatment can temporarily provide a high-speed flux suction interrupted zone after the sucking and removal process of the high-speed flux, blown against the scavenging device by the conjugating spun bond method, and before the heat treatment. Also, within the high-speed flux suction interrupted zone, a web-opening device or the like may also be used. An example of the device includes an air exhaustion device, sandwiching the high-speed flux suction interrupted zone, on the bottom and/or top section. Particularly, when the air exhaustion device is applied to the bottom and top sections of the device, the exhaustion devices are applied so as to alternate the blasting directions of air flux, thus floating the web in a moderate wave form by the exhaustion of the air. At least one air exhaustion-type opening device mentioned above is required. However, if there are two to four devices sandwiching the web for each the top and bottom sections, the preliminary bulkiness treatment is more effective. The introduced air may be of relatively low temperature around 5°–40° C., or can be of relatively high temperature around 41°–180° C. Furthermore, as another preliminary bulkiness treatment, a corona discharge device or the like may be applied in the high-speed air flux suction section. In addition, a mechanically drawing, softening, or the like device is also effective. For instance, a web can be moderately drawn between pinch rollers applied in multiple stages, can be opened by rotating a roller having a plurality of needle-shape protrusions or the like, or the like.

A web is heated at a temperature higher than the melting temperature after the preliminary bulkiness treatment, thus fusing and adhering the intersections of the conjugated filaments and preparing a thermally fused nonwoven fabric. The heat treatment uses a hot air circulating type, heat through-air type, infrared heater type, vertical hot air exhausting type, hot embossed roller type, etc. heat treatment device. When the specific volume of the nonwoven fabric is roughly 15–30 cc/g, the hot embossed roller type and infrared heater type heat treatment device can be preferably used. Also, if the specific volume is roughly 18–35 cc/g, the hot air circulating type and heat through air type heat treatment device would be preferably used. Particularly, the heat treatment with the heat through-air type device is preferable to improve bulkiness. The heat treatment by the hot embossed roller type device can improve the speed of manufacturing nonwoven fabrics, so that the device is highly productive and economical.

When the convex area of the embossed roller is relatively small or the convex section is relatively high, relatively bulky nonwoven fabrics are provided. Thus, the convex section is preferably around 4–25% per area of the roller surface; the convex section is preferably around 0.2–12 mm high.

If the heat treatment period is set relatively long or the conditions of the through-air are empirically set with the application of the heat through-air type heat treatment device, bulky nonwoven fabrics would be provided.

In case relatively little pressure is added by using the heat through-air type device or the like, the heating temperature of each heat treatment device should be between the melting point of the low melting point polymer of the conjugated filaments and that of the high melting point polymer. At such temperature, filaments would not be fused, and a web can be prevented from being in a film form. When a heat treatment device such as the hot embossed roller type device or the like is used, the heating temperature is preferably between the softening point of the low melting point polymer of the conjugated filaments and that of the high melting point polymer. The nonwoven fabrics of this invention can be manufactured by selecting the above-mentioned spinning conditions and heat treatment conditions.

The nonwoven fabric of this invention has balanced bulkiness and strength. Thus, this nonwoven fabric can be applied to any field which requires bulkiness and fiber strength at the same time. For example, the fabric is applied as a material for the front and back surface of disposable diapers, wipers, clothing core materials, filters, bandages, etc., and as materials of commodities which are made of three-dimensionally formed fibers. Since the nonwoven fabric of this invention has high fiber strength, it is later processed (e.g., laminated) with other materials such as films and nonwoven fabrics. In manufacturing final commodities, stress or the like may be added to the nonwoven fabric, but the fabric will not break. In other words, the nonwoven fabric of this invention can be applied to manufacture other commodities at high speed and with improved productivity. The nonwoven fabric also has high bulkiness and is porous, so that it has an excellent air-permeability and liquid permeability. Therefore, the nonwoven fabric of this invention is effective for the above-noted purposes.

EXAMPLES

The nonwoven fabric of the invention and the method of manufacturing are explained in detail below. The properties of the nonwoven fabric are measured as follows in each example.

Specific volume (X): A thickness (mm) was measured when a 2 g/cm$^2$ load was added to a sample.

Specific volume X (cc/g)=(thickness (mm)/basis weight (g/m$^2$))×1000, where the basis weight is a weight per 1 m$^2$ (g/m$^2$).

Strength of non-woven fabric (Y): Five 5 cm×12 cm sample pieces were cut from a nonwoven fabric, and the longitudinal directions of the sample piece were fixed as the vertical (MD) and horizontal (CD) directions of the sample piece respectively. A maximum tensile strength (g/5 cm) was measured at a 10 cm gripper distance and a 10 cm/minute elastic stress rate, and was converted to the strength per 1 g/m$^2$ basis weight. The calculated average values of these five samples was used in this example.

Y: a geometrical mean of vertical and horizontal strength of a 5 cm wide nonwoven fiber per 1 g/m$^2$.

$Y=(MD\times CD)^{1/2}$, where MD is vertical strength (unit: g/(g/m$^2$·5 cm) and CD is horizontal strength (unit:g/(g/m$^2$·5 cm).

Crimp number: Based on an electron microscope photo of the nonwoven fabrics, an average was measured from twenty filaments (unit: number of units per 25 mm).

Example 1

A heat through-air nonwoven fabric was manufactured from conjugated filaments by a conjugating spun bond method.

The manufacturing device includes a conjugating spinning device, a high-speed flux suction device, a net conveyer type web scavenging device, a heat through-air type heat treatment device, and the like, and further includes a high-speed flux sucking and removal device at the bottom on an upper stream region of the web scavenging device, and the high-speed flux suction interrupted zone between the high-speed flux sucking and removal device and the heat treatment device. Three air exhaustion type web opening devices are used below and above the net conveyer in the high-speed flux suction interrupted zone, respectively. The top and bottom air exhaustion devices are alternately positioned so as not to face each other. A spinning pack was a sheath-core type spinning pack with a 0.4 mm hole diameter.

A low melting point polymer (high density polyethylene having a 132° C. melting point, 18 MI (190° C., g/ten minutes) and 0.958 density) was used for the sheath section of a filament while a high melting point polymer (polypropylene having a 165° C. melting point, 9.2 MFR (230° C., g/ten minutes) and 3.1 Q) was used for the core section. Thus, a sheath-core type conjugated filament having 50/50 wt. % conjugation ratio was spun. A spinning temperature was 260° C. for the sheath section and 320° C. for the core section. A spun non-drawn filament was pulled by a high-speed flux type sucking and removal device at 3000 m/minute, and was blown against the net conveyer along with the air flux. The blown air flux was sucked and removed by the high-speed flux sucking and removal device at the bottom of the net conveyer. The web had a 1.5 d/f single filament size.

From the bottom and top directions, the web was blown with air at 18° C., thus floating the web vertically so as to form a moderate wave form. This opening treatment was carried out by the web opening devices in the high-speed flux suction interrupted zone. Then, a heat through-air treatment was carried out on the web at 144° C., thereby providing a nonwoven fiber in which the intersections of conjugated filaments were thermally melted and adhered.

This nonwoven fiber had 20 g/m$^2$ basis weight (weight per unit area), 24 cc/g specific volume, and 107 g/(g/m$^2$·5 cm) nonwoven fiber strength (Y). The number of crimps was 8.2/25 mm, and the crimp had a rough U-shape. This nonwoven fabric satisfied the correlation (1), and had a balanced specific volume and strength, so that it can be used as a material for disposable diapers or the like by itself or with other materials.

Example 2

As in Example 1, a heat through-air nonwoven fabric was manufactured from conjugated filaments by a conjugating spun bond method. A spinning pack was a sheath-core type spinning pack with a 0.4 mm hole diameter.

A low melting point polymer (high density polyethylene having a 133° C. melting point, 16 MI (190° C., g/ten minutes) and 0.960 density) was used for the sheath section of a filament while a high melting point polymer (polypropylene having a 164° C. melting point, 7.8 MFR (230° C., g/ten minutes) and 2.6 Q) was used for the core section. Thus, a sheath-core type conjugated filament having 50/50 wt. % conjugation ratio was spun. A spinning temperature was 280° C. for the sheath section and 310° C. for the core section. A spun non-drawn filament was pulled by a high-speed flux type pulling device at 1552 m/minute, and was blown against the net conveyer along with the air flux. The blown air flux was sucked and removed by the high-speed flux sucking and removal device at the bottom of the net conveyer. The web had a 2.9 d/f single filament size.

From the bottom and top directions, the web was blown with air at 24° C., thus floating the web vertically so as to form a moderate wave form. This opening treatment was carried out on the web opening devices applied in Example 1. Then, a heat-through air treatment was carried out on the web at 146° C., thereby providing a nonwoven fabric in which the intersections of conjugated filaments were thermally melted and adhered.

This nonwoven fabric had 31 g/m$^2$ basis weight, 21 cc/g relative capacity, and 131 g/(g/m$^2$·5 cm) nonwoven fiber strength (Y). The number of crimps was 7.0/25 mm, and the crimp had a rough U-shape. This nonwoven fabric satisfied the correlation (1), and had a balanced specific volume and strength, so that it can be used as a material for disposable diapers or the like by itself or with other materials.

Example 3

As in Example 1, a heat through-air nonwoven fiber was manufactured from conjugated filaments by a conjugating spun bond method. A spinning pack was a sheath-core type spinning pack with a 0.4 mm hole diameter.

A low melting point polymer (high density polyethylene having a 133° C. melting point, 18 MI (190° C., g/ten minutes) and 0.958 density was used for the sheath section of a filament while a high melting point polymer (polypropylene having a 165° C. melting point, 8.4 MFR (230° C., g/ten minutes) and 3.4 Q) was used for the core section. Thus, a sheath-core type conjugated filament having 50/50 wt. % conjugation ratio was spun. A spinning temperature was 270° C. for the sheath section and 300° C. for the core section. A spun non-drawn filament was pulled by a high-speed flux type pulling device at 1452 m/minute, and was blown against the net conveyer along with the air flux. The blown air flux was sucked and removed by the high-speed flux sucking and removal device at the bottom of the net conveyer. The web had a 3.1 d/f single filament size.

A heat through-air treatment was carried out on the web at 146° C. after the web was passed through the high-speed flux suction interrupted zone described in in Example 1. (However, the web opening devices were not used.) As a result, a nonwoven fiber was provided in which the intersections of conjugated filaments were thermally melted and adhered.

This nonwoven fabric had 26 g/m$^2$ basis weight, 28 cc/g specific volume, and 97 g/(g/m$^2$·5 cm) nonwoven fabric strength (Y). The number of crimps was 12.1/25 mm, and the crimp had a rough Ω-shape. This nonwoven fabric satisfied the correlation (1), and had a balanced specific volume and strength, so that it can be used as a material for disposable diapers or the like by itself or with other materials.

Example 4

By a conjugating spun bond method similar to the one in Example 1, a nonwoven fabric was manufactured from conjugated filaments by a hot embossed roller. The conjugated filament was the same as the one in Example 1. In addition to the heat through-air treatment device of Example 1, a hot embossed roller crimp type treatment device was also used in this example. This device is a nip type, including a metallic embossed roller having convex surfaces of 14% in area and a metallic flat roller.

As in Example 1, blown air flux was sucked and removed by the high-speed flux sucking and removal device. The web had 1.5 d/f single filament size. The web opening devices of Example 1 were used so as to treat the web in the high-speed flux suction interrupted zone, and the web was then treated by the metallic embossed roller at 136° C. and the metallic flat roller at 130° C. and 28 kg/cm linear load, thus preparing a nonwoven fabric in which the intersections of the conjugated filaments are thermally melted and adhered.

This nonwoven fabric had 19 g/m$^2$ basis weight, 18 cc/g relative capacity, and 112 g/(g/m$^2$·5 cm) nonwoven fabric strength (Y). The number of crimps was 8.0/25 mm, and the crimp had a roughly U-shape. This nonwoven fabric satisfied the correlation (1), and had a balanced specific volume and strength, so that it can be used as a material for disposable diapers or the like by itself or with other materials.

Example 5

By a conjugating spun bond method similar to the one in Example 1, a nonwoven fabric was manufactured from conjugated filaments with a hot embossed roller. In addition to the heat through air treatment device of Example 1, a hot embossed roller crimp type treatment device was also used in this example. This device is a nip type device, including a metallic embossed roller having convex surfaces by 21% (in area) and a metallic flat roller. The spinning pack is a parallel-type spinning pack having a 0.4 mm hole diameter.

A low melting point polymer (propylene•ethylene•butene-1 ternary copolymer having a 134° C. melting point and 38 MI (230° C., g/ten minutes), and a high melting point polymer (polypropylene having a 166° C. melting point, 44 MFR (230° C., g/ten minutes) and 3.0 Q) were applied so as to spin a parallel type conjugated filament having 60/40 wt. % conjugation ratio. A spinning temperature was 260° C. for the ternary copolymer section and 300° C. for the polypropylene section. A spun non-drawn filament was pulled by a high-speed flux type pulling device at 2046 m/minute, and was blown against the net conveyer along with the air flux. The blown air flux was sucked and removed by the high-speed flux sucking and removal device at the bottom of the net conveyer. The web had a 2.2 d/f single filament size.

The web was thermally treated by the metallic embossed roller at 139° C. and the metallic flat roller at 136° C. and 21 kg/cm linear load after the web was passed through the high-speed flux suction interrupted zone as in Example 1. (However, the web opening devices are not used.) As a result, a nonwoven fabric was provided in which the intersections of the conjugated filaments are thermally melted and adhered.

This nonwoven fabric had 23 g/m basis weight, 16 cc/g specific volume, and 108 g/(g/m$^2$·5 cm) nonwoven fabric strength (Y). The number of crimps was 10.1/25 mm, and the crimp had a rough U-shape. This nonwoven fabric satisfied the correlation (1), and had a balanced specific volume and strength, so that it can be used as a material for disposable diapers or the like by itself or with other materials.

Comparative Example 1

As in Example 1, a heat through-air nonwoven fabric was manufactured from conjugated filaments by a conjugating spun bond method. A spinning pack was a sheath-core type spinning pack with a 0.4 mm hole diameter.

A low melting point polymer (polyethylene of high density having a 133° C. melting point, 8 MI (190° C., g/ten minutes) and 0.962 density, and a high melting point polymer (polypropylene having a 165° C. melting point, 8.6 MFR (230° C., g/ten minutes) and 7.2 Q) was used so as to spin a sheath-core type conjugated filament having a 50/50 wt. % conjugation ratio. A spinning temperature was 310° C. for the sheath section and 310° C. for the core section. A spun non-drawn filament was pulled by a high-speed flux type pulling device at 1452 m/minute, and was blown against the net conveyer along with the air flux. The blown air flux was sucked and removed by the high-speed flux sucking and removal device at the bottom of the net conveyer. The conditions were set so as to provide a 3.1 d/f single filament size, but many filaments were broken during the spinning process and could not be spun. Therefore, the spinning speed had to be slowly lowered to 300 m/minute. Then, along with the air flux, the filaments were blown to the net conveyer at 300 m/minute. The blown air flux was sucked and removed by the high-speed flux sucking and removal device at the bottom of the net conveyer. The web had a 15 d/f single filament size. The web consisted of filaments with a heavy denier due to the end breakage and the adherence of filaments during the spinning process.

The web was opened by the web opening devices of Example 1 after the web was passed through the high-speed flux suction interrupted zone. The web was then treated with a heat through air treatment at 142° C. As a result, a nonwoven fabric was provided in which the intersections of conjugated filaments were thermally melted and adhered.

This nonwoven fabric had 41 g/m2 basis weight, 16 cc/g specific volume, and 82 g/(g/m$^2$·5 cm) nonwoven fabric strength (Y). The number of crimps was 3.8/25 mm, and the crimp had a rough Ω-shape. Even though this nonwoven fabric had a relatively large specific volume, it did not satisfy the correlation (1) due to an unsatisfactory strength level. Therefore, it was judged that the fiber could not be used as a material for disposable diapers or the like by itself or with other materials.

Comparative Example 2

As in Comparative in Example 1, a nonwoven fabric was manufactured from conjugated filaments, but with a hot embossed roller.

After the conjugated filament web having a 15 d/f single filament size was passed through the high-speed flux suction interrupted zone, the opening treatment was carried out on the web as in Comparative Example 1. Then, the web was thermally treated by the metallic embossed roller at 136° C. and with 14% convex area, and the metallic flat roller at 136° C. and 40 kg/cm linear load, thus providing a nonwoven fabric in which the intersections of the conjugated filaments are thermally melted and adhered.

This nonwoven fabric had 39 g/m basis weight, 12 cc/g specific volume, and 136 g/(g/m$^2$·5 cm) nonwoven fabric strength (Y). The number of crimps was 3.4/25 mm, and the crimp had a rough U-shape. This nonwoven fabric had a great strength, but its specific volume was too small (not reaching 15 cc/g). Thus, it was found that the fabric was unsuitable for disposable diapers or the like by itself or with other materials.

Comparative Example 3

As in Example 1, a heat through-air nonwoven fabric was manufactured from conjugated filaments by a conjugating spun bond method. However, the heat through-air treatment was carried out right after the suction and removal of the high-speed flux at the scavenging device without carrying out the preliminary bulkiness treatment to the web. A spinning pack was a sheath-core type spinning pack with a 0.4 mm hole diameter as in Example 1.

The low melting point polymer, high melting point polymer, etc. and spinning conditions and the like were the same as the ones in Example 1

In other words, right after the air flux was sucked and removed, the heat through-air treatment was carried out on the web at 145° C., thus providing a nonwoven fabric in which the intersections of conjugated filaments were thermally melted and adhered.

This nonwoven fabric had 21 g/m$^2$ basis weight, 9.7 cc/g specific volume, and 141 g/(g/m$^2$·5 cm) nonwoven fabric strength (Y). The number of crimps was 1.1/25 mm, and the crimp had a rough U-shape. Even though this nonwoven fabric had relatively high strength, its specific volume was too small (not reaching 15 cc/g). Therefore, it was found that the fiber was not suitable for disposable diapers or the like by itself or with other materials.

Comparative Example 4

A hot embossed roller crimping nonwoven fabric was manufactured from filaments by a regular spun bond method. The manufacturing device was the same as the one in Example 1. Only one extruder was used for spinning, and a spinning pack for regular fibers having a 0.4 mm hole diameter was used.

Polypropylene having 165° C. melting point, 62 MFR (230° C., g/ten minutes) and 4.4 Q was used to spin a regular filament made of a single component. The spinning temperature was 310° C., and the spinning speed by the high-speed flux pulling device was 2143 m/minute. The air flux blown to the net conveyer was sucked and removed by the high-speed flux sucking and removal device at the bottom of the net conveyer. The web had a 2.1 d/g single filament size.

After the web was passed through the high-speed flux suction stopping region, it was treated by a hot embossed roller at 145° C. and with 21% convex area and by a metallic flat roller at 140° C. and with 28 kg/cm linear load, thus providing a nonwoven fabric in which the intersections of the filaments are thermally melted and adhered.

This nonwoven fiber had 22 g/m$^2$ basis weight, 5.7 cc/g specific volume, and 162 g/(g/m$^2$·5 cm) nonwoven fabric strength (Y). The number of crimps was 0.4/25 mm, and the crimp had a rough U-shape. Even though this nonwoven fabric had relatively high strength, its specific volume was too small (not reaching 15 cc/g). Therefore, it was found that the fabric was not suitable for disposable diapers or the like by itself or with other materials.

The invention may be embodied in other forms without departing from the spirit or essential characteristics thereof. The embodiments disclosed in this application are to be considered in all respects as illustrative and not restrictive, the scope of the invention is indicated by the appended claims rather than by the foregoing description, and all changes which come within the meaning and range of equivalency of the claims are intended to be embraced therein.

What is claimed is:

1. A filament nonwoven fabric comprising conjugated filaments in which intersections of said conjugated filaments are melted, said filament nonwoven fabric having a specific volume of 15–35 cc/g and satisfying the Following formula (1) between strength and specific volume;

$$Y \geqq -1.25X+125 \quad (1)$$

wherein Y is a geometrical mean of vertical and horizontal strength per 5 cm wide and 1 g/cm nonwoven fabric (unit: g/(g/m$^2$·5 cm); $Y=(MD \times CD)^{1/2}$ where MD is vertical strength (unit: g/(g/m$^2$·5 cm) and CD is horizontal strength (unit: g/(g/m$^2$·5 cm); and X=specific volume of a nonwoven fabric (unit: cc/g);

wherein said conjugated filaments comprise a low melting point polymer and a high melting point polymer with said low melting point polymer on at least one section of a filament surface and have crimps; and wherein melting points of said low melting point polymer and said high melting point polymer differ by at least 15° C.

2. The filament nonwoven fabric according to claim 1, wherein the low melting point polymer is a polyethylene of high density which has 0.950–0.965 density at 20 MI or less.

3. The filament nonwoven fabric according to claim 1, wherein the high melting point polymer is a crystalline polypropylene having a 3.5 or less Q value at 10 or less MFR.

4. The filament nonwoven fabric according to claim 1, wherein the conjugated filaments have 1–80 crimps/25 mm.

5. The filament nonwoven fabric according to claim 4, wherein the conjugated filaments have 1.2–70 crimps/25 mm.

6. The filament nonwoven fabric according to claim 4, wherein the conjugated filaments have 1.5–60 crimps/25 mm.

7. The filament nonwoven fabric according to claim 1, wherein the shape of the crimps is selected from at least one of a rough U-shape, rough Ω-shape, rough V-shape, spiral shape, and a mixture of these shapes.

8. The filament nonwoven fabric according to claim 1, wherein the composition ratio of the low melting point polymer and the high melting point polymer in the conjugated filaments is about 10–90 wt. % for the low melting point polymer and about 90–10 wt. % for the high melting point polymer.

9. The filament nonwoven fabric according to claim 8, wherein the composition ratio is about 30–70 wt. % for the low melting point polymer and about 70–30 wt. % for the high melting point polymer.

10. The filament nonwoven fabric according to claim 1, wherein the conjugated filaments comprise thermoplastic polymer.

11. The filament nonwoven fabric according to claim 10, wherein the thermoplastic polymer is at least one selected from the group consisting of polyamide, polyester, polyolefin and a mixture of two or more of three polymers.

12. The filament nonwoven fabric according to claim 1, wherein the conjugated filaments are selected from at least one of a high density polyethylene/polypropylene, low density polyethylene/propylene•ethylene•butene-1 ternary copolymer, high density polyethylene/polyethylene terephthalate, polypropylene/polyethylene terephthalate, mixture of straight-chain low-density polyethylene and high density polyethylene/polypropylene.

13. The filament nonwoven fabric according to claim 12, wherein the conjugated filaments comprises polyethylene/polypropylene.

14. The filament nonwoven fabric according to claim 12, wherein the polyethylene has about 0.950–0.965 density, and has an about 20–6 MI (melt index; 190° C.; g/10 minutes; by ASTM-D-1238 (E)), and the polypropylene preferably has about 10–6 MFR (melt flow rate; 230° C.; g/10 minutes; JIS-K-7210; based on Condition 14 of Table 1) and has around 3.5–1.5 Q value (average molecular weight (Mw)/average molecular weight (Mn)).

15. The filament nonwoven fabric according to claim 1, wherein the specific volume is 15–30 cc/g.

16. A sanitary material in which the filament nonwoven fabric according to claim 1 is used for at least one section thereof.

17. A method of manufacturing a filament nonwoven fabric comprising the steps of:

spinning conjugated filaments, which comprise a low melting point polymer and a high melting point polymer, by a conjugating spun bond method;

blowing webs by a high-speed flow against a scavenging device and sucking and removing a blown high-speed air flow from said scavenging device;

carrying out a preliminary bulkiness treatment;

adding crimps and bulkiness, and thermally fusing intersections among the conjugated filaments by treating the web with heat at a temperature higher than a melting temperature of the conjugated filaments, thus manufacturing a filament nonwoven fabric having a 15–35 cc/g specific volume and satisfying the conditions between the strength and specific volume of the nonwoven fabric shown in the following Formula (1);

$$Y \geqq -1.25X+125 \quad (1)$$

wherein Y is the geometrical mean of vertical and horizontal strength per 5 cm wide and 1 g/cm nonwoven fabric (unit: g/(g/m$^2$·5 cm); $Y=(MD \times CD)^{1/2}$ where MD is vertical strength (unit: g/(g/m$^2$·5 cm) and CD is horizontal strength (unit: g/(g/m$^2$·5 cm); and X=specific volume of a nonwoven fabric (unit: cc/g); and wherein melting points of the low melting point polymer and the high melting point polymer differ by at least 15° C.

18. The method o manufacturing a filament nonwoven fabric according to claim 17, wherein the heat treatment is a heat through-air treatment at a temperature between the melting point of the low melting point polymer and the melting point of the high melting point polymer.

19. The method of manufacturing a filament nonwoven fabric according to claim 17, wherein the heat treatment is thermo-compression ression bonding by a hot embossed roller at a temperature between the softening point of the low melting point polymer and the melting point of the high melting point polymer.

20. The method of manufacturing a filament nonwoven fabric according to claim 17, wherein after the high-speed flow is sucked and removed from the scavenging device, and the preliminary bulkiness treatment provides a high-speed flow suction interrupted zone in a process before the heat treatment of the web.

* * * * *